United States Patent [19]

Onoe et al.

[11] 4,135,529

[45] Jan. 23, 1979

[54] COIN CLASSIFICATION DEVICE IN COIN PROCESSING MACHINE

[75] Inventors: Katuhiko Onoe; Takashi Tanaka, both of Himeji, Japan

[73] Assignee: Glory Kogyo Kabushiki Kaisha, Japan

[21] Appl. No.: 885,042

[22] Filed: Mar. 9, 1978

[30] Foreign Application Priority Data

Mar. 12, 1977 [JP] Japan ..... 52-27499

[51] Int. Cl.[2] ..... G07D 3/12

[52] U.S. Cl. ..... 133/3 C; 133/8 R

[58] Field of Search ..... 133/3 R, 3 C, 3 D, 3 E, 133/3 H, 8 R

[56] References Cited

U.S. PATENT DOCUMENTS

| | | | |
|---|---|---|---|
| 3,009,555 | 11/1961 | Seckula, Sr. | 133/3 R X |
| 3,125,102 | 3/1964 | Bower | 133/8 R X |
| 3,173,431 | 3/1965 | Chichester et al. | 133/3 R |
| 3,187,759 | 6/1965 | Rausing | 133/3 R |
| 4,059,122 | 11/1977 | Kinoshita | 133/8 R X |

*Primary Examiner*—Joseph J. Rolla

*Attorney, Agent, or Firm*—Beveridge, De Grandi, Kline & Lunsford

[57] ABSTRACT

In a coin classification device in a coin processing machine, coins of various denominations received in a coin receiving section and sent one after another into a coin passageway by a coin picking-up device are classified in-sequence from higher denomination to lower denomination by a plurality of respective rollers arranged along the coin feeding passageway with respective lowest parts at different heights above the passageway and operating to kick or flip coins of respective denominations off the passageway. The coins thus classified are then guided through a plurality of respectively separate passages to separate coin depositing positions to be processed as desired.

5 Claims, 10 Drawing Figures

COIN CLASSIFICATION DEVICE IN COIN PROCESSING MACHINE

BACKGROUND OF THE INVENTION

This invention relates to coin processing machines, and more particularly to a coin classifying device which classifies coins of various denominations dropped into a coin processing machine with respect to their denominations. The coins thus classified are further subjected to a process such as counting.

A coin processing machine of a type comprising a coin receiving section wherein coins of various denominations to be processed are received, a coin pick-up device of a rotating disc type provided in the coin receiving section for picking up coins one after another from the coin receiving section and feeding them into a coin feeding passageway, and a coin classifying device arranged along the coin feeding passageway for classifying the coins passing therethrough by their denominations and guiding the thus classified coins into separate positions has been heretofore known.

This coin classifying device has comprised a plurality of curved members of different sizes arranged along the coin feeding passageway, each of the curved members being adapted to pass coins of lower denominations (that is, of smaller diameters) but deflect coins of a specific denomination (or diameter) through a separate passage into a separate coin depositing position.

In the above described type of coin processing machine, however, several difficulties have been experienced.

One of the difficulties is that when a coin of a denomination is caught by a curved member adapted to classify the same coin, the velocity of the coin is reduced, whereby the coin tends to be struck by a succeeding coin or coins of lower denomination. In other words, when a coin of a greater diameter is classified by a curved member corresponding thereto, another coin of a smaller diameter tends to collide with the greater diameter coin, with the result that both of the coins are deflected together into a coin depositing position for the greater diameter coin, thus causing an erroneous classification of the coins.

Another problem accompanying the conventional coin processing machine is that the coins deflected by the curved pieces as described above roll down over the surfaces of guide plates provided in the respective passages. Thus, when the number of coins of a specific denomination is counted by a counting device provided in each of the passages, the attitude of the coins passing across the counting device cannot be stable, thus tending to cause erroneous counting of the coins.

If it is desired to prevent rolling down of the coins by increasing the lenths of the coin passages for stabilizing the attitude of the coins at the time of the counting operation, the elongated coin passages not only increase the size of the machine but also make it difficult to obtain assured stacking of the coins in the coin depositing positions.

SUMMARY OF THE INVENTION

A primary object of the present invention is to provide a coin classifying device in a coin processing machine whereby the above described problem accompanying the conventional coin classifying device can be substantially eliminated.

Another object of the invention is to provide, in a coin processing machine, a coin classifying device, the operation of which is accurate and reliable in spite of the miniaturized size of the classifying device.

According to the present invention there is provided a coin classifying device in a coin processing machine, having a coin pick-up device provided in a coin receiving section for picking up coins of various denominations one after another, and a coin feeding passageway extending obliquely downwardly from the coin receiving section and comprising a coin rolling track and a coin supporting plate; the improvement comprising a plurality of rollers provided above the coin feeding passageway to be rotated in such a direction that the peripheral parts of the rollers are moved substantially perpendicularly to the coin feeding passageway and adapted to separate coins of respective denominations of respective diameters, and means for driving the plurality of rollers in said direction, whereby each of said rollers separates coins of its respective diameter corresponding to the height from the coin rolling track to the lowest peripheral part of that roller, out of the coin rolling track into a respectively separate collecting means, and the rollers thereby classify the coins in sequence from those of the greatest diameter to those of the smallest diameter.

Preferably the rollers are fixedly mounted on a shaft rotatably supported above and along the coin feeding passageway, and the rollers are rotated in a direction-forcing the upper edges of the coins rolling along the coin rolling track toward the coin supporting plate. Preferably a plurality of coin dropping members are provided along the coin rolling track of the coin feeding passageway in vertical alignment with the plurality of rollers thereby facilitating the displacement of the lower edges of the coins rolling along the coin rolling track away from the track.

The shaft may be disposed parallel to the coin feeding passageway while each of the rollers is provided with a conical peripheral surface, or otherwise the shaft may be disposed obliquely to the coin feeding passageway while each of the rollers is provided with a cylindrical peripheral surface, so that a surface contact (not point contact) is maintained between the rollers and the coins.

The invention will be more clearly understood when the following detailed description is read in conjunction with the accompanying drawings wherein like parts are designated by like reference numerals.

DETAILED DESCRIPTION

As conducive to a full understanding of the present invention, a conventional coin processing machine will first be described with reference to FIGS. 1 and 2.

Figure 1:
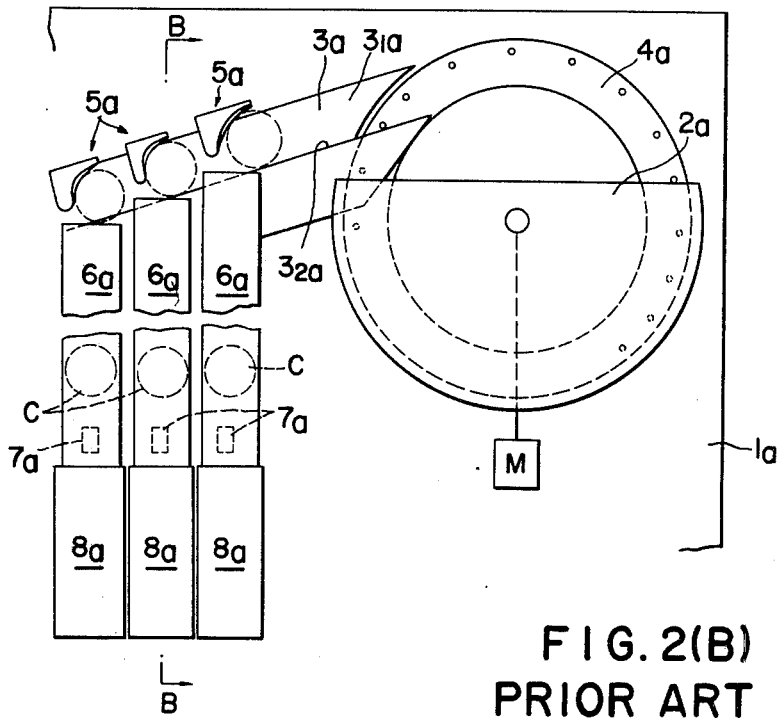
FIG. 1 PRIOR ART
FIG. 1 is a front elevational view of a conventional coin classifying device.

The coin processing machine schematically illustrated in FIGS. 1 and 2 includes a mixed-coin receiving section 2*a* provided in an upper part of the main body 1*a* of the coin processing machine. In the mixed coin receiving section 2*a*, there is provided a coin pick-up disc 4*a* rotated by an electric motor M around a shaft extending substantially horizontally but with a slight angle of inclination so that the coin supporting surface of the disc 4*a* is tilted rearwardly for facilitating support of coins. The coin pick-up disc 4*a* can pick up one after another coins C of various denominations received in the coin receiving section 2*a* and deliver the coins in succession into a coin feeding passageway 3*a* which extends obliquely downwardly from the coin pick-up disc 4*a*.

The passageway 3*a* is made of a coin supporting plate $3_{1a}$ delimited along its lower edge by a stepped portion acting as a track $3_{2a}$ on which the coins thus delivered from the coin pick-up disc 4*a* are allowed to roll downward. The passageway 3*a* is also slightly tilted around its longitudinal axis rearwardly for facilitating support of the coins rolling along the track $3_{2a}$ by the supporting plate $3_{1a}$.

Along the lower end of the coin passageway 3*a*, a coin classification device comprising, for instance, three members 5*a* for classifying coins of a large diameter, medium diameter, and a smaller diameter, are arranged in this order along the coin feeding direction of the passageway 3*a*. Below the coin classifying members 5*a*, three separate passages 6*a* extend also obliquely downwardly for guiding the coins C classified by the coin classifying members 5*a* toward coin depositing positions 8*a*, respectively. A coin counting device 7*a* may be provided in each of the passages 6*a* for counting the coins C.

Figure 2B:
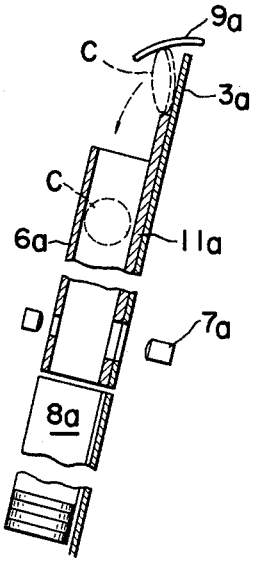
FIG. 2(B) PRIOR ART
FIGS. 2(A) and 2(B) are a partial plan view of the conventional device and a sectional view taken along the line B—B in FIG. 1, respectively.
Figure 2A:
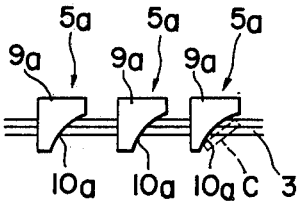
FIG. 2(A) PRIOR ART

As shown in detail in FIGS. 2(A) and 2(B), each of the conventional coin classifying members 5*a* may be made of a curved member 9*a* of a special configuration adapted to pass those coins having diameters smaller than a specific value for the member 9*a* but deffecting those coins having diameters equal to or greater than the specific value along a curved edge 10*a* of the same member 9*a* toward the corresponding passage 6*a*. The coins guided into the passage 6*a* then drop by their own weight along the same passage toward the corresponding one of the coin depositing positions 8*a*.

In the conventional coin processing machine of the above described construction, however, when a coin C of a great diameter rolls down under the force of gravity along the stepped portion $3_{1a}$ of the coin passageway 3, the coin collides with the curved piece 9*a* thereby reducing its speed. The coin then tends to be struck by the succeeding coin or coins of probably smaller diameters, with the result that the coins of the greater diameters are deflected together with the coin or coins of the smaller diameter through the passage 6*a* into the coin depositing position 8*a* assigned for the coins of the great diameter, thus causing an erroneous classification and an erroneous coin counting operation.

Furthermore, the coins thus deflected by the curved member 9*a* tend to roll down on and along a coin guide plate 11*a* in the coin passage 6*a*, which is tilted slightly relative to a vertical plane. As a result, the attitude of the coins passing through the coin counting device 7*a* cannot be stable, thus giving rise to another cause of erroneous counting of the coins.

In a case where the length of the tilted guide plate 11*a* is increased for terminating the rolling of the coins passing therealong prior to the coin counting device 7*a*, not only is the size of the coin processing machine thereby increased, but the coin stacking operation in the coin depositing position 8*a* is also made difficult.

All of these difficulties accompanying the conventional coin classifying device can be substantially eliminated by an improvement according to the present invention which will now be described in detail with reference to FIGS. 3 through 7 wherein like members are designated by like reference numerals.

Figure 3:
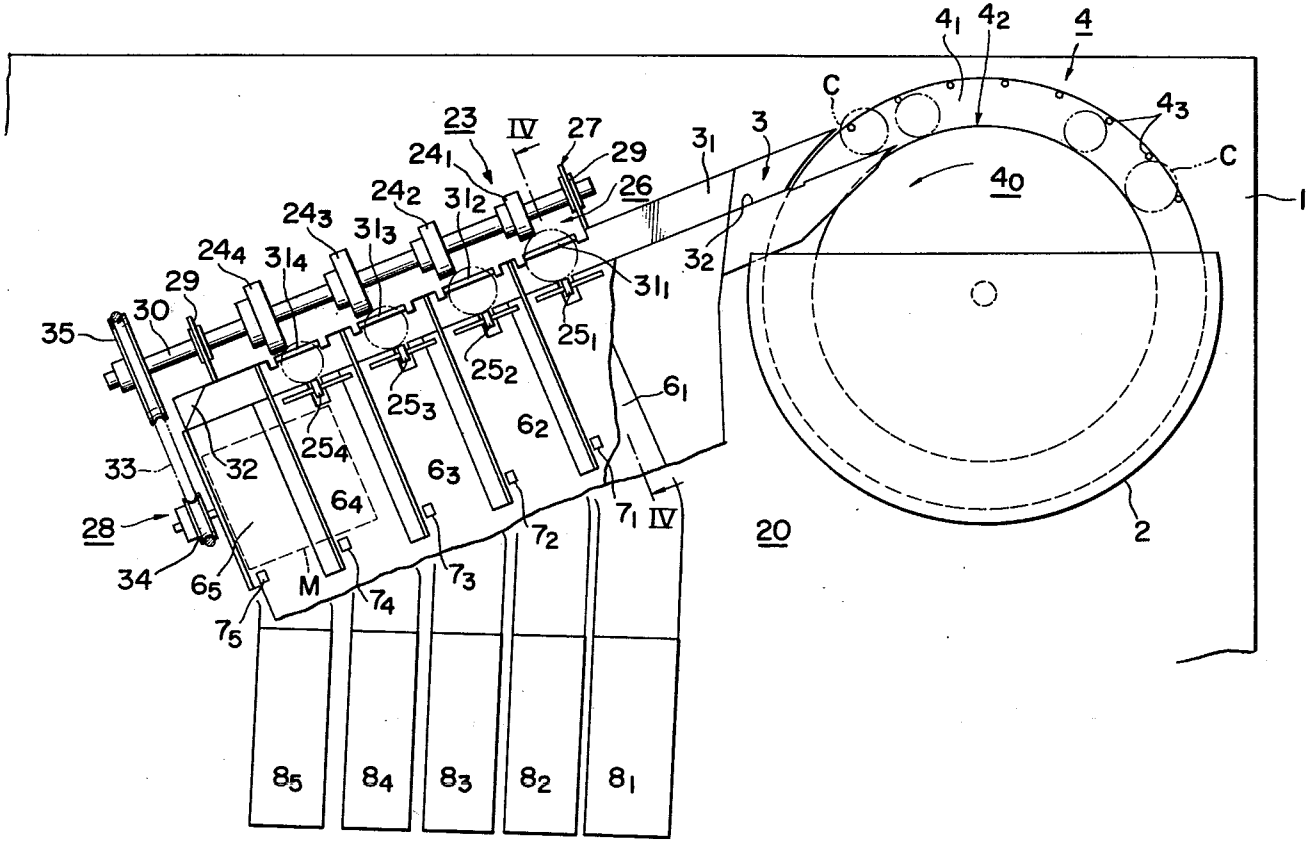
FIG. 3 is a front elevational view of an embodiment of the present invention.
Figure 4:
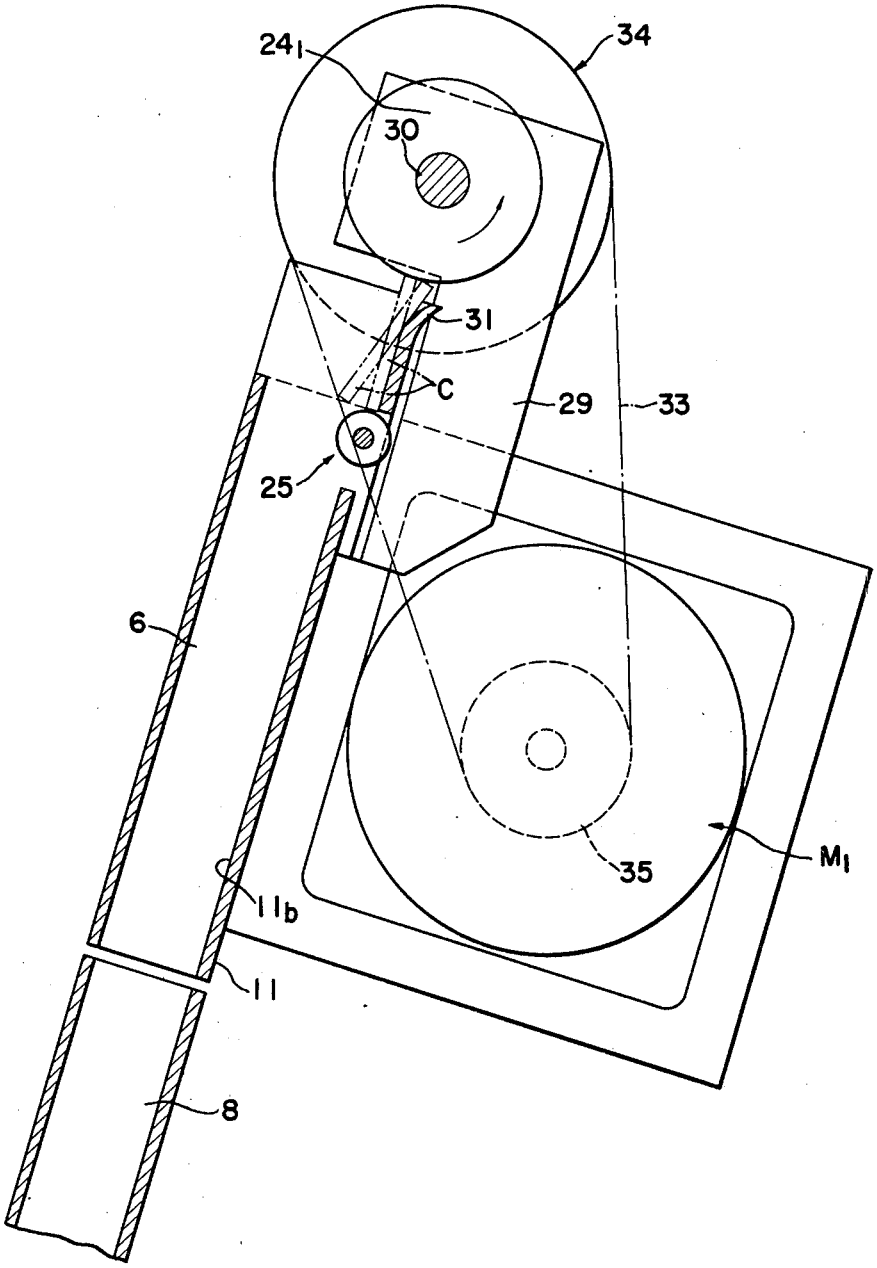
FIG. 4 is a relatively enlarged sectional view taken along the line IV—IV in FIG. 3.

Referring first to FIGS. 3 and 4, there is shown a coin processing machine provided with a coin classification device constituting a first embodiment of the present invention. The coin processing machine comprises a mixed coin receiving section 2 provided in an upper part of the main structure 1 of the coin processing machine, and a coin feeding device 4 provided in the coin receiving section 2 for delivering the mixed coins dropped into the coin receiving section 2 into a coin feeding passageway 3.

The coin feeding device is similar to the above described conventional device and includes a rotatable disc $4_0$ having a brim portion $4_1$ and a central portion $4_2$ raised or protruding toward the front. The rotatable disc $4_0$ is rotated by an electric motor M about the central axis of the disc $4_0$ which is tilted by a small angle from the horizontal direction for facilitating the support of the coins on the brim portion $4_1$, each coin being caught between two of a number of pins $4_3$ which are implanted on the front side of the brim portion $4_1$ at equal intervals concentrically with the raised central portion $4_2$.

The rotatable dic $4_0$ of the above described construction picks up mixed coins C received in the coin receiving section 2, each coin being held between two adjacent pins $4_3$ and the peripheral surface of the central portion $4_2$ as described above and shown in FIG. 3, and delivers the coins thus picked up into the coin feeding passageway 3 one after another.

The coin feeding passageway 3 comprises a coin supporting plate $3_1$ with a stepped portion $3_2$ functioning as a coin rolling track formed along the lower edge of the plate $3_1$. The entire passageway 3 is longitudinally inclined downwardly in the coin feeding direction, and transversely tilted by a small angle as in the case of the rotatable disc $4_0$, so that the coins passing through the passageway 3 can ride more stably on the stepped portion $3_2$ with the side surfaces of the coins leaning against the coin supporting plate $3_1$.

Along the lower part of the coin passageway 3, there is provided a coin classifying device, which is in its entirety designated by the reference numeral 23. The coin classifying device 23 classifies the mixed coins passed through the coin passageway 3 with respect to their diameters, and delivers the coins thus classified through classified-coin passages $6_1$ through $6_5$ to coin depositing position $8_1$ through $8_5$, respectively. Coin counting devices $7_1$ through $7_4$ may be provided at intermediate points of the passages $6_1$ through $6_4$ for counting the coins passing therethrough.

According to the present invention, the coin classifying device 23 comprises a plurality of cylindrical rollers such as $24_1$ through $24_4$, provided above the coin feeding passageway 3, a device 27 for supporting the rollers rotatably, a roller driving device 28, and a plurality of coin dropping members such as $25_1$ through $25_4$.

The rollers $24_1$ through $24_4$ which are preferably made of rubber are provided in a number corresponding to that of the denominations of the coins to be classified and are fixedly mounted on a shaft 30 supported rotatably by two bearing brackets 29 of the supporting device 27 fixed to the rear surfaces of the coin passages $6_1$ and $6_5$. The rollers $24_1$ through $24_4$ are driven in the counterclockwise direction as indicated by arrow mark in FIG. 4 by the driving device 28 which comprises pulleys 34 and 35 driven by the electric motor M, and an endless belt 33 stretched around the pulleys 34 and 35.

The shaft 30 is provided with its axis substantially in an extension, as shown in FIG. 4, of the plane of the guiding surface $11_b$ of a guide plate 11 constituting the rear wall of each coin passage $6_1$- - - or $6_5$ which is also tilted by an angle. The diameters of the rollers $24_1$ through $24_4$ supported by the shaft 30 are so selected that the distance between the stepped portion or the coin rolling track $3_2$ of the coin feeding passageway 3 and the lowermost part of each of the rollers $24_1$, $24_2$, - - -, or $24_4$ is slightly narrower than the diameter of the coins to be classified by that specific roller, but is greater than the diameters of the coins of lower denominations. Thus each roller can pass the coins of the lower denominations therethrough, but cannot pass coins of the specific denomination corresponding to that roller, which are kicked or flipped at their upper edges by the specific roller as will be described hereinafter in more detail.

The coin dropping members $25_1$ through $25_4$ are provided in the same level as that of the stepped portion $3_2$ constituting the coin rolling track of the coin feeding passageway 3. The members $25_1$ through $25_4$ may be formed into bearing rollers as shown in FIG. 4, or into stationary members made of a tape material of low friction. In cooperation with the cylindrical rollers $24_1$ through $24_4$ which are rotated counterclockwisely as viewed in FIG. 4 to kick the upper edges of the coins arriving along the stepped portion $3_2$ of the coin passageway 3 rearwardly, the coin dropping members $25_1$ through $25_4$ push the lower edges of the coins forwardly out of the stepped portion $3_2$. As a result, the coins caught by any one of the rollers $24_1$ through $24_4$ are caused to slide down along the guiding plate 11 of the corresponding one of the passages $6_1$ through $6_4$ without varing the attitude of the coins while the coins slide down from the stepped portion $3_2$ of the coin feeding passageway 3 into the passage.

Furthermore, backwardly bending portions $31_1$ through $31_4$ may be provided along the upper edge of the coin guiding plates 11 at positions aligned vertically with the coin dropping members $25_1$ through $25_4$, respectively, for facilitating the rotating displacement of the coins due to the rollers $24_1$ through $24_4$ and the dropping-out members $25_1$ through $25_4$.

In this embodiment of the invention, only a projection 32 is formed in the lowermost end of the coin feeding passageway 3 for dropping the coins C which have passed through all of the cylindrical rollers $24_1$ through $24_4$ into the lowermost passage $6_5$. This is because only coins of a single denomination arrive at the lowermost end, and any collision therewith of the succeeding coins causes no error in the classification and counting.

Figure 5:
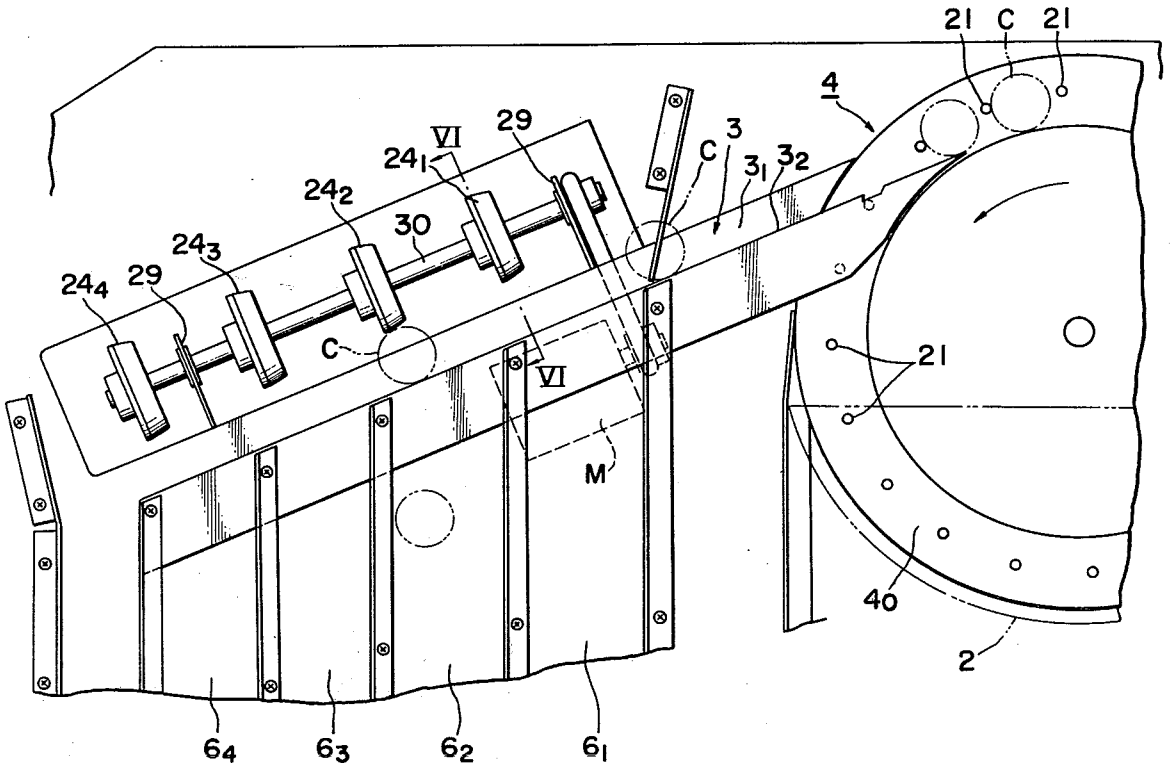
FIG. 5 is a front elevational view of another embodiment of the invention.
Figure 6:
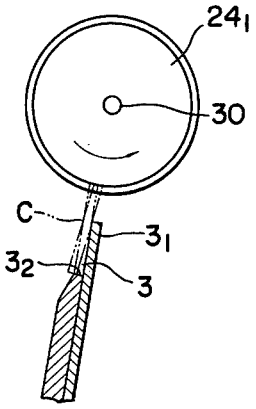
FIG. 6 is a sectional view taken along the line VI—VI in FIG. 5.
Figure 7:
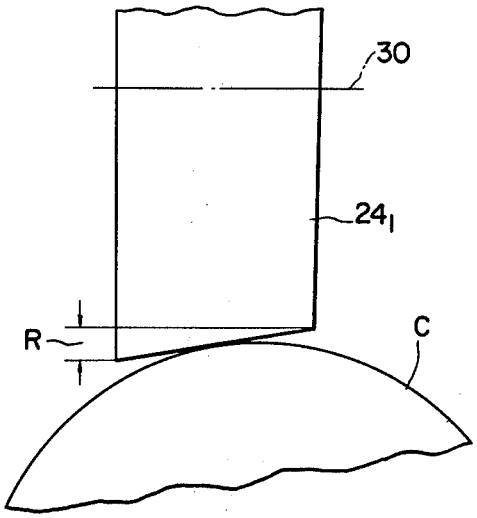
FIGS. 7, 8, and 9 are views for a description of still other embodiments of the invention.

In another example shown in FIGS. 5, 6, and 7, each of the rollers $24_1$ through $24_4$ has a frustoconical shape with a taper, indicated by the difference R between the radii of the two ends thereof, covering an allowable range of errors in the diameter of coins C to be classified. Furthermore, the distance between the stepped portion $3_2$ of the coin feeding passageway 3 and each roller, particularly at least on the greater-diameter side of the roller, is selected to be slightly smaller than the outer diameter of the coins C to be classified by the roller.

In addition, the central axis of the shaft 30 is disposed, as shown in FIG. 6, in an extension of the plane of the coin supporting surface of the coin supporting plate $3_1$ as in the first-embodiment, so that the upper edge of a coin C on the stepped portion $3_2$ can be kicked or flipped by the corresponding roller most effectively. Each of the rollers $24_1$ through $24_4$ is preferably made of a resilient material such as rubber at least in the peripheral part thereof as in the first embodiment.

Figure 9:
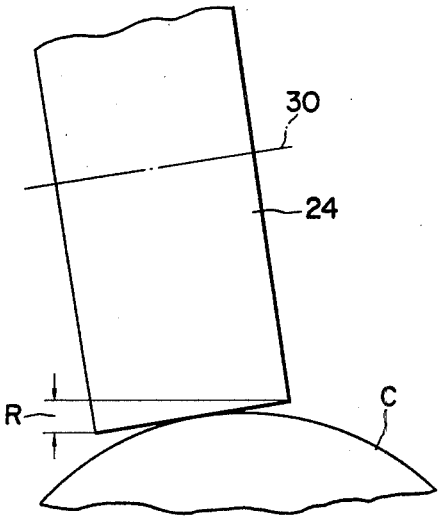
Figure 8:
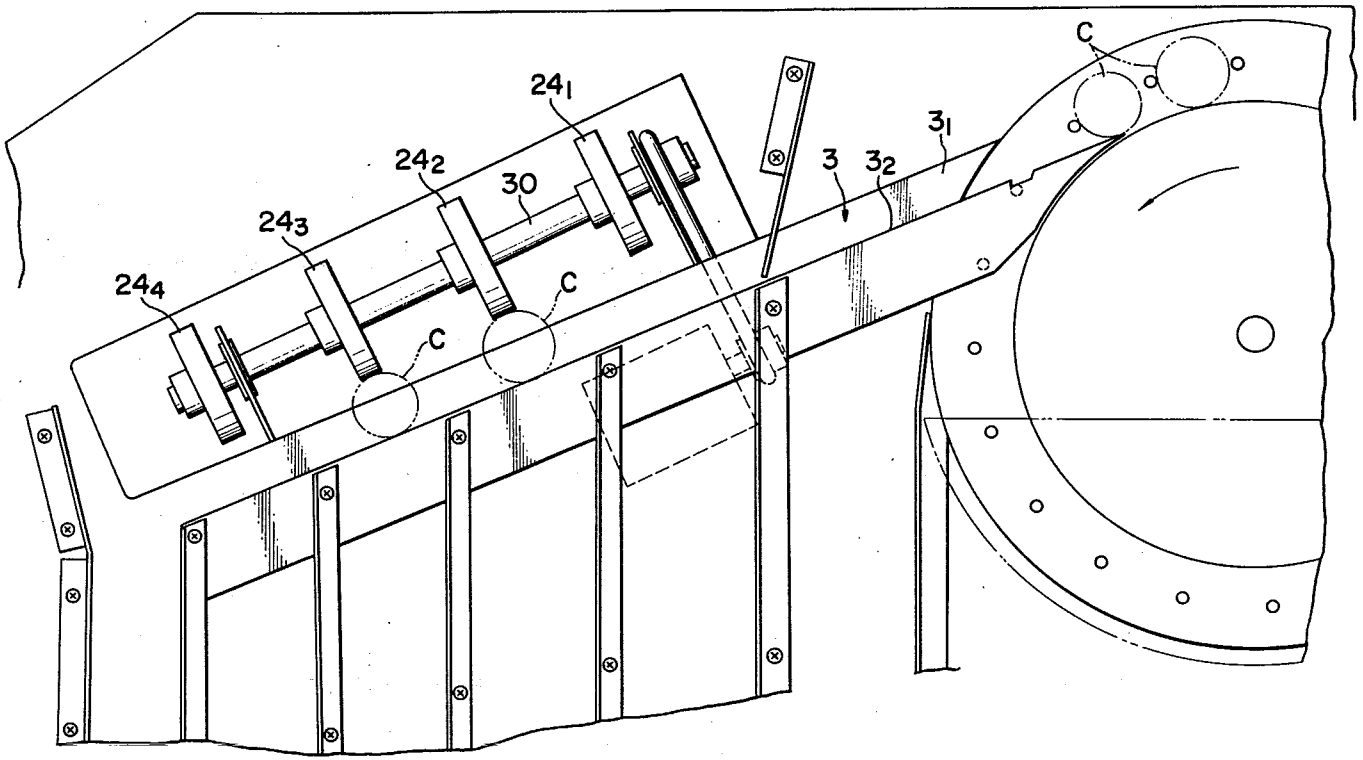

In FIG. 8 showing still another embodiment of the present invention, ordinary cylindrical rollers $24_1$ through $24_4$ are utilized, and the shaft 30 supporting these rollers is further tilted relative to the stepped portion $3_2$ of the passageway 3 which is longitudinally tilted relative to a horizontal plane. By this arrangement, the same difference R as in the second embodiment of the invention shown in FIG. 7 can be provided between the distance between the leading edge of each roller and the stepped portion $3_2$ and the distance between the trailing edge of the roller and the same stepped portion $3_2$ as shown in FIG. 9.

In the operation of the coin classification device according to this invention, the coins to be classified are dropped into the coin receiving section 2 of the coin processing machine, and the electric motor M is started for rotating the coin pick-up device and the rollers $24_1$ through $24_4$. Thus, the coins received in the coin receiving section 2 are picked up one after another by the pins 21 implanted on the rotatable disc $4_0$ and sent into the coin passageway 3. Since the passageway 3, comprising the coin supporting plate $3_1$ and the stepped portion $3_2$ constituting the coin rolling track, extends leftwardly downwardly as viewed in FIG. 3, and is tilted around its longitudinal axis for supporting the coins rolling along the stepped portion $3_2$ on the coin supporting plate $3_1$ as described hereinbefore, the coins C sent into the coin feeding passageway 3 roll down by their own weight along the stepped portion $3_2$.

Each coin of the greatest diameter is then caught by the first roller $24_1$ rotating in the counterclockwise direction as viewed from the side near the coin pick-up device 4, with the uppermost edge of the coin kicked rearwardly by the roller. At this time, because of the provision of the curved portion $31_1$ in the coin guiding plate 11 and the coin dropping member 25 along the stepped portion $3_2$ on which the lower edge of the coin rides, the coin thus kicked by the roller $24_1$ can be easily displaced out of the stepped portion $3_2$ to slide down along the passage $6_1$.

Each coin with the next greatest diameter fed through the coin feeding passageway 3 passes by the first roller $24_1$ but is caught by the second roller $24_2$, and is caused to slide down the second passage $6_2$ as in the case of the greatest diameter coins.

The same operation is repeated for the coins with smaller diameters, and the coins thus classified according to their diameters (or denominations) are caused to slide down along the passages $6_3$, $6_4$, and $6_5$ without changing their attitude, whereby elongated passages as in the conventional device are not required, and a reduction in the size of the coin processing device is afforded.

The coins sliding down the passages $6_1$ through $6_5$ are counted by the coin counting devices $7_1$ through $7_5$ as described hereinbefore. Since the attitude of the coins at the time the coins pass through the light rays of the counting devices $7_1$ through $7_5$ is not changed, the accuracy of the counting operation is greatly improved. The coins thus counted are stacked in the coin depositing positions $8_1$ through $8_5$ into, for instance, cylinders which may be replaced when filled by the coins.

Although curved portions 31, through $31_4$ are provided in the above described examples, there may be unnecessary in some cases if the height of the coin supporting plate $3_1$ is low relative to the diameters of the coins. The rotating direction of the rollers $24_1$ through $24_4$, which was described to be counterclockwise, may also be changed clockwise when a high falling speed of the coins in the passages (or chutes) $6_1$ through $6_5$ is required. The coin counting devices $7_1$ through $7_5$ may also be omitted when the machine is operated simply as a coin classifying machine.

Although the plurality of rollers $24_1$ through $24_4$ have been rotated by a single shaft 30, the invention is not limited by such a construction, and the rollers may be rotated by means of separate shafts which may also be driven through appropriate coupling means from a single driving source or be driven by separate driving sources correspondingly provided therefor.

We claim:

1. In a coin classifying device in a coin processing machine, having a coin pick-up device provided in a coin receiving section for picking up coins of various denominations one after another, and a coin feeding passageway extending obliquely downwardly from the coin receiving section and comprising a coin rolling track and a coin supporting plate; the improvement comprising a plurality of rollers provided above the coin feeding passageway to be rotated in a given direction, the plurality of rollers being positioned such that the peripheral parts of the rollers are moved substantially perpendicularly to the coin feeding passageway and disposed to separate coins of respective denominations having respective diameters, and means for driving the plurality of rollers in said direction, whereby each of said rollers separates coins of respective diameter corresponding to the height from the coin rolling track to the lowest peripheral part of that roller out of the coin rolling track into a respectively separate collecting member, and the rollers being disposed to classify the coins in sequence from those of the greatest diameter to those of the smallest diameter.

2. A coin classifying device as set forth in claim 1 wherein said plurality of rollers are rotated in such a direction as to displace the upper edges of the coins rearwardly toward the coin supporting plate of the coin feeding passageway and to displace the lower edges of the coins forwardly to move out of the coin rolling track.

3. A coin classifying device as set forth in claim 1 wherein said plurality of rollers are of a cylindrical configuration and are supported by a single shaft extending substantially in the coin feeding direction in the coin feeding passageway.

4. A coin classifying device as set forth in claim 3 wherein said shaft extends in parallel with said coin rolling track in the coin feeding passageway, and each of said plurality of rollers is of a fructoconical configuration having a diameter constantly increasing toward the downstream end of the coin feeding passageway.

5. A coin classifying device as set forth in claim 3 wherein said plurality of rollers are of a cylindrical configuration and are supported by a single shaft obliquely disposed relative to the coin rolling track of the coin feeding passageway in a converging manner toward the downstream end of the coin feeding passageway.

* * * * *